United States Patent [19]

Anderson

[11] Patent Number: 4,660,612

[45] Date of Patent: Apr. 28, 1987

[54] CORDLOCK STRUCTURE FOR A BLIND ASSEMBLY HAVING IMPROVED LOCKING MEANS

[75] Inventor: Richard N. Anderson, Owensboro, Ky.

[73] Assignee: Hunter Douglas, Inc., Totowa, N.J.

[21] Appl. No.: 722,243

[22] Filed: Apr. 11, 1985

Related U.S. Application Data

[63] Continuation-in-part of Ser. No. 706,432, Feb. 27, 1985.

[51] Int. Cl.[4] ..... E06B 9/324

[52] U.S. Cl. ..... 160/173; 160/178 C

[58] Field of Search ..... 160/178 R, 178 B, 178 C, 160/168 R, 166, 173, 84 R

[56] References Cited

U.S. PATENT DOCUMENTS

| | | | |
|---|---|---|---|
| 2,105,082 | 1/1938 | Johnson | 160/173 |
| 3,130,776 | 4/1964 | Van Thienen | 160/178 R |
| 3,221,802 | 12/1965 | Hurkmans | 160/173 |
| 4,488,588 | 12/1984 | McClure | 160/178 C |

FOREIGN PATENT DOCUMENTS 059807 8/1981 European Pat. Off. .

*Primary Examiner*—Ramon S. Britts
*Assistant Examiner*—Cherney S. Lieberman
*Attorney, Agent, or Firm*—Pennie & Edmonds

[57] ABSTRACT

A cordlock structure adapted to be applied to an end of a headrail supporting a blind assembly. The structure has a base member adapted to be fixed to the headrail and a cap member. The cap member includes a locking dog assembly which is moved to a cord unlocking position by moving operating cords hanging from the assembly in a direction away from the plane of the blind assembly or in a direction parallel to the plane of and towards the center of the blind assembly.

The cordlock structure includes wear surfaces having superior wear properties over which the cords pass and may include a cover member adapted to overlay the cap member.

10 Claims, 9 Drawing Figures

CORDLOCK STRUCTURE FOR A BLIND ASSEMBLY HAVING IMPROVED LOCKING MEANS

CROSS-REFERENCE TO OTHER APPLICATIONS

This application is a continuation-in-part of my copending application Ser. No. 706,432, filed Feb. 27, 1985.

FIELD OF THE INVENTION

This invention relates to a cordlock structure for a blind assembly. More particularly the invention relates to a cordlock structure of a small unobtrusive size when applied to a headrail and which may be operated by moving cord locking means to a locked and unlocked position by in turn moving blind operating cords away from or towards the blind assembly in one form of the invention or generally parallel to the plane of the blind assembly in a further form of the invention.

BACKGROUND OF THE INVENTION

Conventional cordlock structures often include a locking means comprising a locking dog assembly made up of a long first arm pivotally connected to the cap portion and a short arm pivotally connected to the long arm. Each arm has a locking portion on the distal end thereof adapted to lockingly engage with blind operating cords passing therebetween and the pivot axes of the two arms are positioned inside of the path of the operating cords through the cap portion with respect to the blind assembly. In some cordlock structures having this type of locking means, it is necessary in order to lower the blind assembly to pull the operating cords slightly in a vertical direction beneath the locking means, and then release the cords under the control of the operator until the blind is lowered the desired amount after which the operator stops the cords with his hand and pulls the cords away from the blind assembly in order to lock the locking means.

In order to raise the blind assembly with this type of locking means, the cords are pulled either downwardly or to one side or outwardly of the blind assembly and then locked in the same manner as in lowering the blind assembly. A problem with this structure however is that if the operator accidentally releases an operating cord, except at the designated locking position where the cord is pulled away from the plane of the blind assembly, the blind assembly supported by the cord will fall to a tilted or fully down position.

Cordlock structures having the locking means as described above could be made to automatically lock when the operating cord drops or falls to a vertical position and be unlocked by moving the cords in a direction towards the plane of the blind assembly. This would require that the cap portion containing the locking means be positioned sufficiently away from the plane of the blind assembly so that there is room to move the operating cord towards the blind assembly without interferring with the blind assembly. This positioning of the cap portion a sufficient distance away from the plane of the blind assembly would result in the cordlock structure being larger than is aesthetically desirable.

In some instances it is desirable that the cords operate in planes substantially parallel to the plane of the blind assembly and be pulled in a direction towards the center of the blind assembly during raising or lowering. This occurs particularly when drapes may be positioned at ends of the blind assembly which would then interfere with cords being moved towards and away from the plane of the blind assembly. Conventional cordlock structures may be modified to allow movement of the cords in a plane parallel to the plane of the blind assembly by turning the structure 90° towards the blind but then the structure is incapable of being used where it may still be desirable to also have an operating mode in which the cords can be moved towards or away from the plane of the blind assembly. Further if the operator were to accidently release the cords using such conventional cordlock structure, they would fall to a vertical position allowing the blind assembly to fall to a tilted or fully lowered position as previously explained.

Cordlock structures are conventionally made of plastic moldings and because of expense and color retention characteristics, plastics are often used which do not have good wear resistant properties. Modern blind assemblies have small diameter operating cords to improve the appearance of the blind assembly, and where the blind assembly is of substantial weight, these small diameter cords may wear and gouge into the plastic material comprising the cordlock assembly. Because of expense of material, and difficulty in coloring and color retention of some plastic materials, it often is not feasible to make the cordlock structure of highly wear resistant structure.

The headrails and slats of blind assemblies often come in a variety of colors, and for aesthetic reasons, it is desirable that the colors making up the various parts of the blind assembly, including cordlock structures, be the same or coordinated with each other. This however may present a problem, as in the case of cordlock structures, if inventories of many different colored structures must be maintained.

It is therefore an object of my invention to provide for a cordlock structure which will have a locking means which will automatically move to a locked position when operating cords beneath the locking means are moved or allowed to move to a vertical position and which may be moved to an unlocked position by moving the cords away from the plane of the blind assembly.

It is still a further object of my invention to provide for a cordlock structure which will be unobtrusive and which at the same time may be operated by moving blind operating cords in a plane parallel to the blind assembly or by moving the cords away from the blind assembly and which will have a locking means which will move automatically to a locked position when the cords are moved to or allowed to fall to a vertical position.

It is also an object of the invention to provide for a cordlock structure which includes a cover which may cover the external surfaces of the locking structure and where the cover is of a color to coordinate with the color of a headrail.

It is a further object of my invention to provide for a cordlock structure which may comprise an inexpensive plastic material having desired color and color retention properties and which at the same time will have wear resistant surfaces to prevent wear or gouging by blind operating cords.

GENERAL DESCRIPTION OF THE INVENTION

Broadly a cordlock structure according to my invention comprises a base member which has a connecting means for fixing the structure to one end of a headrail 5 suppoting a blind assembly and a cap member attached to the base member. The structure utilizes a conventional locking dog assembly having a long first arm pivotally connected to the cap member and a short second arm pivotally connected to the first arm. Each arm is adapted to be mounted for rotational movement about an axis extending transversely to the path of blind operating cords through the cap member and each arm has a locking portion on the distal end thereof such that the locking portions are adapted to lockingly engage the operating cords. The cords are movable with respect to the plane of the blind assembly between locking and unlocking positions such that when the arms are pivoted to an upward position by movement of the cords, they will lock the operating cords against movement in one direction, and when the arms are moved to a lower position, they will unlock to allow the cords to move in two directions. This conventional locking dog assembly is according to the invention installed in a cap member such that the pivot axes of the first and second arms are positined outside of the path of the operating cords through the cap member with respect to the blind assembly.

In one form of the invention the pivot axes are further positioned parallel to the blind assembly. This assures that the arms may be unlocked with respect to the operating cords by moving the cords in a direction away from the blind assembly without interference with the blind assembly and also that the arms will move to lockingly engage the operating cords when the cords move or fall towards the blind assembly where they will hang vertically from the locking means. This particular construction allows use of a small cordlock construction wherein the cap member is positioned only a short distance from the plane of the blind assembly since it is not necessary to provide a large space between the locking means and plane of the blind assembly in order to move the cords towards the blind assembly to actuate and unlock the locking arms.

In a further form of the invention the pivot axes are positioned in the manner as described above except that the pivot axes are inclined with respect to the blind assembly and preferably at substantially 45° to the plane of the blind assembly. In this manner the operating cords may be moved to an unlocked positon by moving the cords in a plane extending between the plane of the blind assembly and 45° with respect thereto and towards the center of the blind as may be desirable when the end of the blind asembly is covered by drapes, or the cords may be moved away from the blind in a plane extending between a plane perpendicular to the blind assembly and 45° with respect thereto.

I have found that operating cords of a blind assembly using a cordlock structure as described may operate the cordlock-lock structure if the cords are pulled either in a direction perpendicular to the pivot axes or in any direction up to substantially 45° with respect to the pivot axes. If the cords are pulled in a direction exceeding 45° inclination with respect to the pivot axes, the blind assembly can be raised, however when the cords are released under operator control to lower the blind assembly, the locking dog assembly will grab and lock the cords regardless of whether the cords are allowed to hang in a vertical direction or are held under operator control away from the blind. Thus having the pivot axes extend 45° with respect to the plane of the blind provides for an operating range in which the cords may be pulled of 90° extending between a plane perpendicular to the blind assembly and a plane parallel to the blind assembly.

In addition the invention may include a separate wear surface positioned in the base or cap member comprising a wear resistant material having greater wear resistant properties than the material comprising the cap member and such that the operating cords pass thereover. This construction prevents the operating cords from cutting or gouging into portions of the base and cap members while at the same time allowing the main portion of the base member to be made of a less expensive material than that of the wear resistant surface and of a material which may have better dyeing and color retention properties. For example I have found that the main portions of the cordlock structure, namely the base member and cap member, may be made of a polycarbonate material which is relatively inexpensive and has good color retention properties and where the wear resistant surface comprises a harder material, such as nylon which is more expensive than the polycarbonate material. The wear surface may be formed as a separate insert placed along a cord passage extending through the base member and/or the cap member.

The cordlock structure of the invention further preferably includes a cover member which is adapted to fit over the cap member. This allows the base member and cap member to be of any color while the cover member may be coordinated with the color of the headrail and/or slats of the blind assembly. Since the cap member is of relatively simple, small construction as compared to the base and cap member, the expense of maintaining an inventory of covers of various colors as compared with maintaining an inventory of base and cap members of various colors is reduced.

DESCRIPTION OF THE PREFERRED EMBODIMENTS

Figure 1:
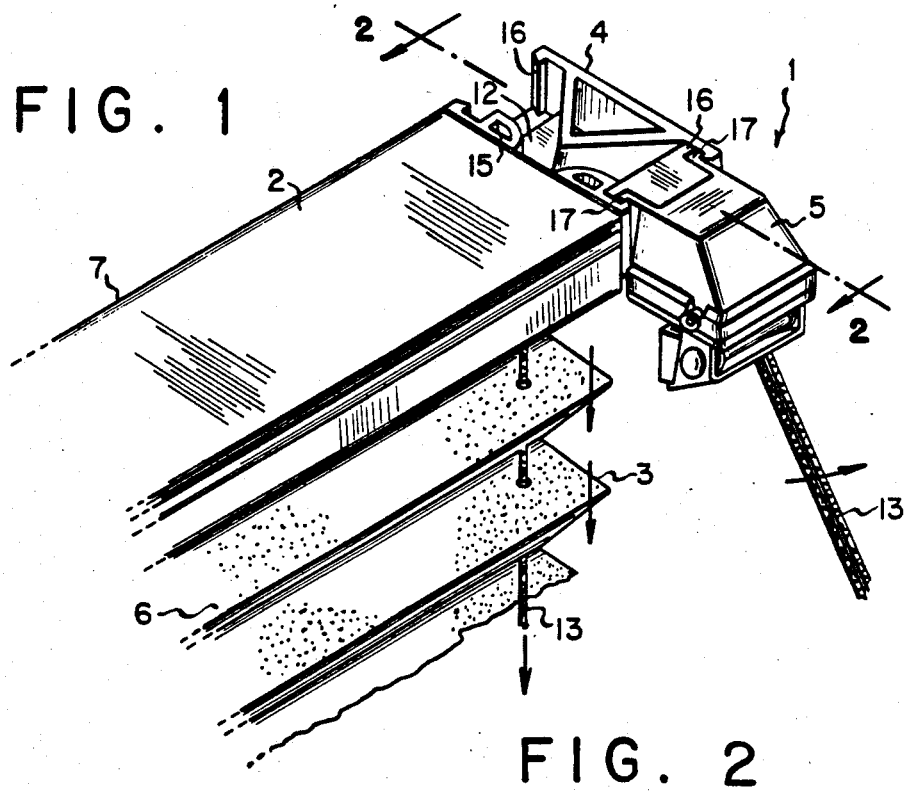
FIG. 1 is a perspective view of a cordlock structure according to the invention as applied to a headrail supporting a blind asembly.

Referring to FIG. 1 there is illustrated a cordlock structure 1 applied to one end of a headrail 2 supporting a blind assembly 3 which may be in the form of a pleated blind, as shown, or in the form of a conventional blind assemlby having a plurality of slats.

The cordlock structure comprises a base member 4 and a separate cap member 5 which is adapted to be fixed to the base member 4 on either a front side 6 or a rear side 7 of the headrail 2.

Figure 4:
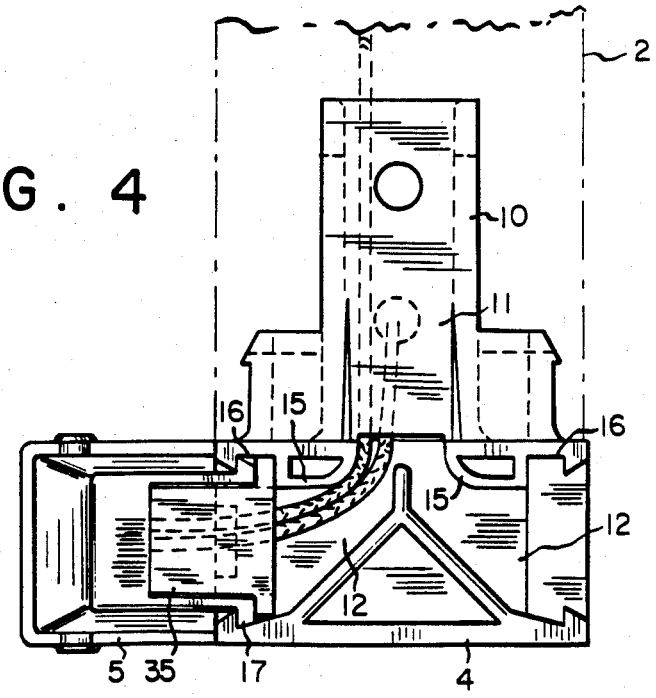
FIG. 4 is a plan view of the cordlock structure of FIG. 1.

The base member 4 as shown in FIG. 4 has a connecting means 10 which may be inserted into the end of the headrail 2 in order to fix the base member and the attached cap member to the headrail. The base member has a cord passage 11 extending longitudinally through the connecting means 10 and cord passages 12 extending laterally in the base member through which operating cords 13 are threaded so as to pass around guide portions 15.

The base member 4 as shown in FIGS. 1 and 4 has two oppositely disposed first fastening means 16 in the form of grooves which are adapted to engage with a second fastening means 17 in the form of flanges contained on the walls of the cap member.

The cords 13 extend through the cord passage 11 and either of the cord passages 12 over a cord engaging surface 18 downwardly through the cap member 5 to engage a locking dog assembly 20.

Figure 2:
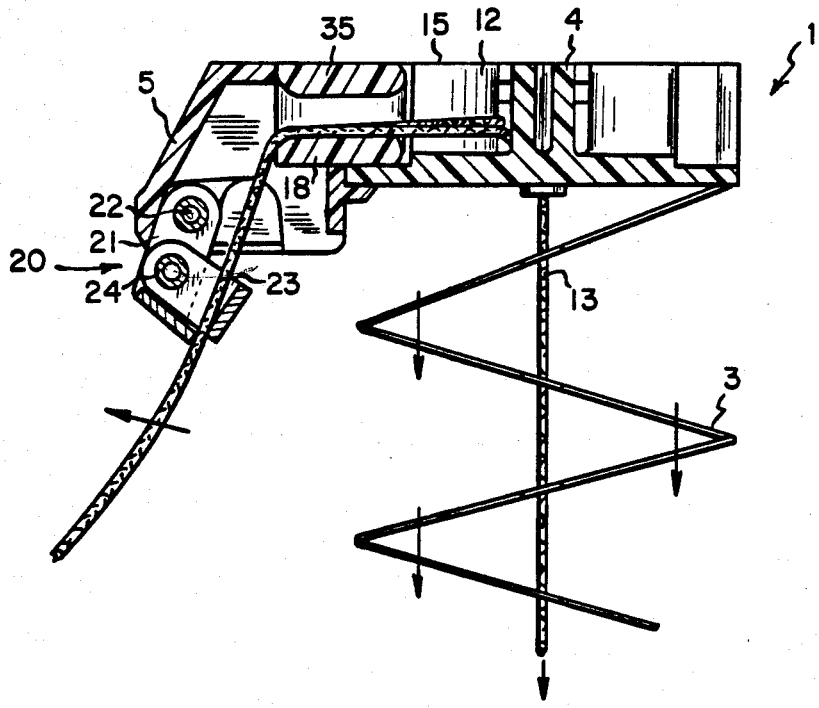
FIG. 2 is an enlarged cross-sectional view of FIG. 1 taken along lines 2—2 and illustrating movement of the locking means of the cordlock structure to an unlocked position.

The locking dog assembly 20 as shown in FIG. 2 comprises a first long arm 21 which is pivotally mounted to the base member by a pin 22. A short arm 23 is pivotally mounted to the long arm by a pin 24 and the cords 13 pass between the distal ends of the arms 21 and 23. When it is desired to lower the blind assembly, the cords 13 are moved away from the plane of the blind assembly 3 as shown in FIGS. 1 and 2 causing the arms to unlock with respect to the cords 13 and allowing the weight of the blind asembly 3 to move downwardly with respect to the headrail. This movement of the cords 13 away from the blind assembly assures that the cords do not interfere with the blind assembly or with any window structure that might be associated with the blind assembly. This construction allows the cap member 5 to be moved close to the plane of the blind assembly thus reducing the over size of the cordlock structure and improving its appearance when applied to a headrail.

Figure 3:
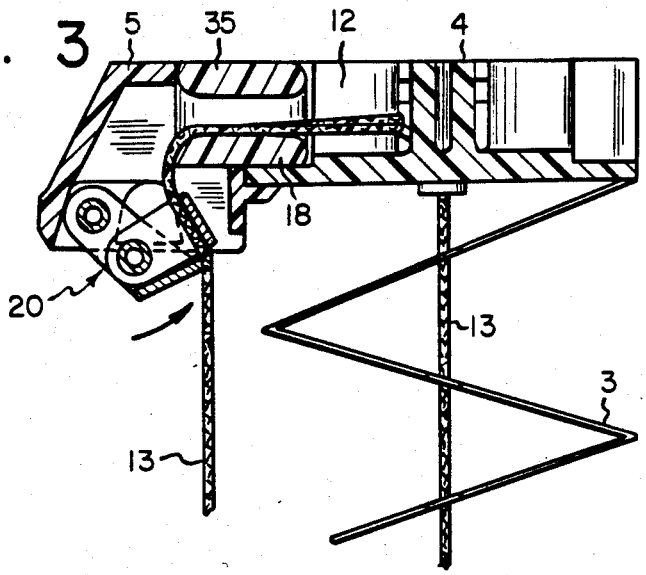
FIG. 3 is a view similar to FIG. 2 illustrating movement of the locking means to a locked position.

In order to lock the operating cords into place at the desired blind height, the operating cords are moved to the vertical position as shown in FIG. 3 which raises the arms to the position shown at which point the distal ends will lock the cords. This locking results from the action of gravity of the second arm 23 pivoting on the first arm 21. Since the cords lock when in the vertical position as shown in FIG. 3, it is apparent that if the operator were to mistakeningly drop the cords while either raising or lowering the blind assembly, that the cords will swing into the vertical locking position as shown in FIG. 3 preventing any dropping of the blind assembly.

To raise the blind assembly, the cords 13 may be pulled vertically downwardly in the position as shown in FIG. 3 preventing any dropping of the blind assembly.

A wear surface insert 35 as shown in FIGS. 2, 3 and 4 comprises a hollow member, a portion of which is adapted to fit into the base member 4 and extend into the cap member 5 such that the cords 13 pass over the insert and are guided into contact with the locking dog assembly. While the insert as shown is generally annular in form, it could, if necssary, include extensions to form a further guide to guide the operating cords from the longitudinally extending passage 11 contained in the base member and to guide the cords in a lateral direction with respect to the base member. Such an extension would in effect replace guide surfaces 15 as shown in FIGS. 4 and 5 which may be subjected to wear by contact with the operating cords.

Figure 5:
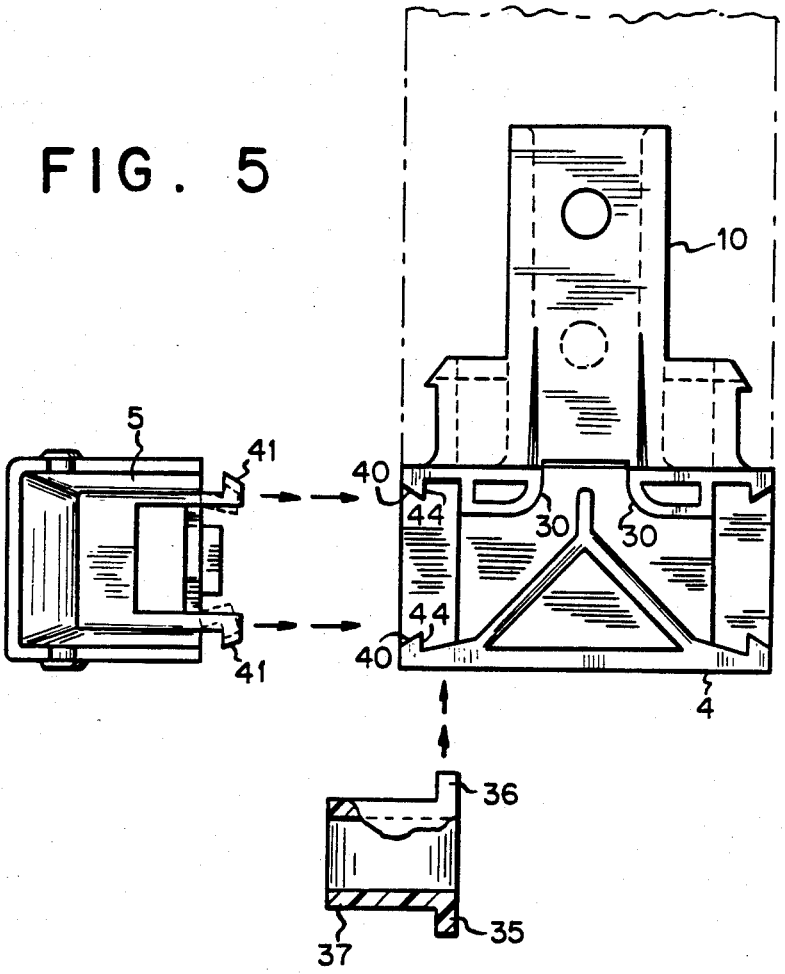
FIG. 5 is an exploded plan view of the cordlock structure shown in FIG. 4 illustrating the manner of assembly.
Figure 6:
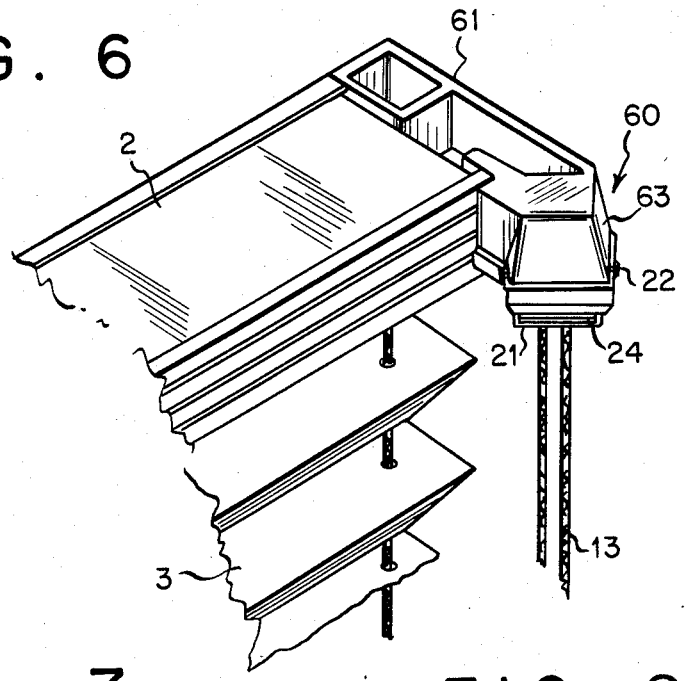
FIG. 6 is a perspective view of a further embodiment of a cordlock structure according to the invention as applied to a headrail supporting a blind assembly.
Figure 7:
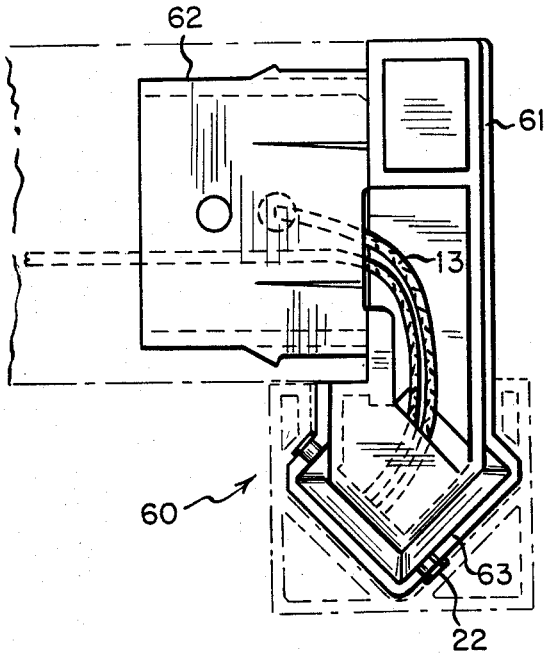
FIG. 7 is a plan view of the cordlock structure of FIG. 6.

The flanges 17 of member 5 are flexible or resilient and are adapted to be snapped into place by moving the cap member in the direction shown in FIG. 5 towards the base member such that tapered surfaces 40 contained on the base member engage tapered surfaces 41 on the flanges to move the flanges inwardly as shown in dotted lines in FIG. 5 so that they snap into place upon moving beyond the surfaces 40.

The wear resistant insert 35 is then adapted to be moved downwardly onto the top of the base member so that the rim 36 will, as shown in FIG. 5, slide in between the end of the flanges 17 and base member 4. The tubular portion 37 of the insert will then prevent the flexible flanges 17 from being moved inwardly towards one another thus preventing their ends from disengaging from the shoulders 44 contained on the base member. The insert 35, in addition to providing a wear resistant surface, thus provides a lock to prevent the cap member from becoming separated from the base member.

As shown in FIG. 4, the base member has an open top so that it is not necessary to rethread the operating cords from the blind assembly through the base member upon movement of the cap member to either side of the base member.

Referring to FIGS. 6–9 in which parts like those shown in FIGS. 1–5 have like identification numerals, there is illustrated a further form of the invention having a modified cordlock structure 60 which like the cordlock structure 1 comprises a base member 61, a connection means 62 and a cap member 63. The construction of the cordlock structure 60 differs mainly from that of cordlock structure 1 in the positioning of the cap member at an inclined angle with respect to the plane of the blind assembly and specifically in positioning the cap member so that the pivot axes 22 and 24 of the locking dog assembly are inclined substantially 45° to the plane of the blind assembly and extend in a direction towards the center of the blind assembly.

Inclination of the pivot axes substantially at 45° with respect to the blind assembly provides for an operating range of 90° in which the cords 13 may be moved to unlock the locking dog assembly and which extends between a plane extending parallel to the blind assembly and a plane extending perpendicular to the blind assembly. Thus in the event drapes cover the end of the headrail, the cords may be moved parallel to and towards the center of the blind assembly to unlock the locking dog assembly without interferring with the drapes. In the event no drapes cover the end of the blind assembly, the cordlock structure may still be operated in the same manner as with the embodiment of FIGS. 1–5, namely the blind assembly may be lowered by moving the cords outwardly of the blind assembly and releasing the cords under operator control.

In the event the cords are allowed to fall to a vertical position, the locking dog assembly will automatically lock the cords from further movement to prevent the blind assembly from crashing.

The positioning of the cap member 45° with respect to the blind assembly results in the cap member protruding further from the blind assembly than if positioned in the manner shown in FIG. 1. Thus the particular positioning of the locking dog assembly where the pivot axes are placed outwardly of the path of the operating cords through the cap becomes even more important in order to maintain the size of the cordlock structure within acceptable limits.

Figure 8:
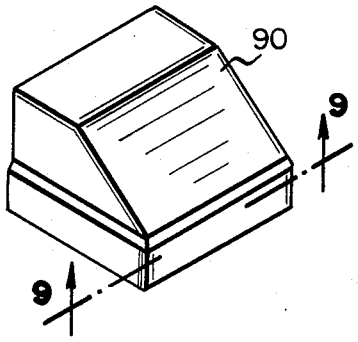
FIG. 8 is a perspective view of a cover member adapted to cover a cap member portion of the cordlock structure of FIG. 6; and, FIG. 9 is a cross-section of the cover member of FIG. 8 take along lines 9—9.
Figure 9:
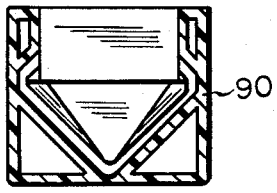

In order to reduce inventory of cordlock structures and to provide color coordination between the cordlock structures and various colored headrails and slats, the cordlock structure may include a cover member as shown in FIGS. 8 and 9 adapted to be slid over the cap member 63. The result is that one relatively expensive cordlock structure of a single basic color may be stocked for attachment to one end of a headrail while a large number of relatively inexpensive cover members may be stocked to provide necessary color coordination.

While the cordlock structure of FIGS. 6–10 does not specifically disclose any separate wear surface of a wear resistant material, such a surface could easily be incorporated in either the cap or base member and have extensions extending into the other member along the path of the cords in the same general manner as with the wear resistant surface shown in FIGS. 1–5.

It is seen that a cordlock construction as disclosed in the drawings provides a structure having a minimum of parts and which may be applied in various positions to a headrail. It is further seen that the locking dog assembly is positioned to assure that the assembly may be easily unlocked by moving operating cords away from the plane of the blind assembly or even parallel to the plane of the blind assembly. Further it is seen that a cordlock construction is provided which may utilize inexpensive material and that surfaces over which cords engage and pass may comprise more expensive wear resistant surfaces to accommodate wear caused by operating cords contacting portions of the cordlock structure.

I claim:

1. A cordlock structure for a blind assembly where said cordlock structure is adapted to be mounted on an end of a headrail of the blind assembly, said structure including a base member having connecting means for fixing said structure to one end of the headrail and a cap member having cord locking means for locking blind operating cords from movement, said structure in mounted position adapted to guide said operating cords in a path through the cap member, said locking means comprising a locking dog assembly having a long first arm pivotally connected to said cap member and a short second arm pivotally connected to said first arm, each said arm adapted to be mounted for rotational movement about an axis extending transversely to the path of the operating cords through the cap member, said arms each having a locking portion on the distal end thereof, said locking portions being adapted to lockingly engage operating cords movably guided therebetween, whereby said arms when pivoted to an upper position will lock said operating cords against movement in one direction and whereby when arms are moved to a lower position will unlock to allow said operating cords to move in two directions, characterized in that the pivot axes of the first arm and second arm are positioned outside of the path of the operating cords through the cap member with respect to the blind assembly.

2. A cordlock structure according to claim 1 further characterized in that said cap member has a separate wear surface associated therewith comprising a wear resistant material having greater wear resistant properties than material comprising said cap member and wherein said operating cords are adapted to pass over said wear resistant material.

3. A cordlock structure according to claim 2 further characterized in that said wear surface is formed by a separate insert positioned along a cord passage extending from the base member to the cap member.

4. a cordlock structure according to claim 1 further characterized in that said pivot axes extend in planes parallel to the plane of the blind assembly.

5. A cordlock structure according to claim 1 further characterized in that said pivot axes are inclined to the plane of the blind assembly.

6. A cordlock structure according to claim 5 further characterized in that said pivot axes are inclined substantially 45° to the plane of the blind assembly.

7. A cordlock structure according to claim 1 further characterized in having in addition a cover member overlying said cap member.

8. A cordlock structure according to claim 7 further characterized in that said cover member is the same color as said headrail.

9. A cordlock structure for a blind assembly where said cordlock structure is adapted to be mounted on an end of a headrail of the blind assembly, said structure including a base member having connecting means for fixing said structure to one end of the headrail and a cap member having cord locking means for locking blind operating cords from movement, said structure in mounted position adapted to guide said operating cords in a path through the cap member, said locking means comprisng a locking dog assembly having a long first arm pivotally connected to said cap member and a short second arm pivotally connected to said first arm, each said arm adapted to be mounted for rotational movement about an axis extending transversely to the path of the operating cords through the cap memeber, said arms each having a locking portion on the distal end thereof, said locking portions being adapted to lockingly engage operating cords movably guided therebetween, the improvement wherein when said arms are pivoted to an upper position, the second arm extends upwardly from its pivot connection on the first connection on the first arm with the locking portion thereof engaging the operating cords to urge them against the locking portion of the first arm by the action of gravity of the second arm pivoting on the first arm to lock said operating cords against movement in one direction and whereby when said arms are moved to a lower position by pulling on the operating cords in a second direction opposite said one direction, the locking portions thereof will unlock to allow said operating cords to move in the two directions, and further characterized in that the pivot axes of the first arm and second arm are positioned outside of the path of the operating cords through the cap member with respect to the blind assembly and on the side of the operating cords away from the blind assembly, and in that the first and second arms both extend from their pivot axes toward the blind assembly when pivoted to said upper position to lock the operating cords as they hand free in a vertical position.

10. The improvement in the cordlock structure according to claim 9 wherein the pivot axes are inclined substantially 45° to the plane of the blind assembly; and the locking portions on the distal ends of each of the arms of the locking dog assembly extend at the same angle as the pivot axes and are disposed in the path of engagement with the locking cords when the locking cords are pulled through an angular range of 90° between a plane extending substantially parallel to the plane of the blind assembly to a plane extending substantially perpendicular thereto.

* * * * *